US011022326B2

(12) United States Patent
Kobayashi et al.

(10) Patent No.: US 11,022,326 B2
(45) Date of Patent: Jun. 1, 2021

(54) HEAT SOURCE UNIT FOR REFRIGERATION APPARATUS

(71) Applicant: DAIKIN INDUSTRIES, LTD., Osaka (JP)

(72) Inventors: Keiko Kobayashi, Osaka (JP); Ying Ying Ji, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 221 days.

(21) Appl. No.: 16/235,184

(22) Filed: Dec. 28, 2018

(65) Prior Publication Data

US 2019/0203957 A1 Jul. 4, 2019

(30) Foreign Application Priority Data

Dec. 28, 2017 (JP) ..... JP2017-254912

(51) Int. Cl.

| | |
|---|---|
| ***F24F 1/30*** | (2011.01) |
| ***F24F 13/20*** | (2006.01) |
| ***F24F 11/84*** | (2018.01) |
| ***F24F 11/56*** | (2018.01) |
| ***F24F 1/26*** | (2011.01) |

(52) U.S. Cl.

CPC ..... *F24F 1/30* (2013.01); *F24F 1/26* (2013.01); *F24F 11/56* (2018.01); *F24F 11/84* (2018.01); *F24F 13/20* (2013.01)

(58) Field of Classification Search

CPC ..... F24F 1/30; F24F 1/56; F24F 1/26; F24F 13/20; F24F 11/84

See application file for complete search history.

(56) References Cited

U.S. PATENT DOCUMENTS

| | | | | |
|---|---|---|---|---|
| 6,178,766 | B1 * | 1/2001 | Tong | F28F 1/126 62/305 |
| 9,791,213 | B2 * | 10/2017 | Yoshioka | F28F 1/40 |
| 2005/0150247 | A1 * | 7/2005 | Ishihara | F24F 1/26 62/507 |
| 2008/0148749 | A1 * | 6/2008 | Ishida | F24F 11/62 62/157 |
| 2009/0044554 | A1 * | 2/2009 | Takeichi | F24F 1/54 62/259.1 |

(Continued)

FOREIGN PATENT DOCUMENTS

JP 2009-024903 A 2/2009

*Primary Examiner* — Ljiljana V. Ciric

(74) *Attorney, Agent, or Firm* — Osha Bergman Watanabe & Burton LLP

(57) ABSTRACT

A heat source unit includes: a casing; a heat exchanger; a fan disposed in the casing and that horizontally blows out the air passing through the heat exchanger; a shut-off valve having a connection port that opens in a direction toward either a front-surface side or a rear-surface side of the casing; and peripheral panels that form a front surface, a rear surface, a left-side surface, and a right-side surface of the casing. The peripheral panels include a first portion that forms the right-side surface. The first portion has a first cut-out portion that exposes the shut-off valve to an exterior of the casing such that the shut-off valve is visible from a right side of the casing without removing any intervening structures between the shut-off valve and the right-side surface of the casing.

18 Claims, 10 Drawing Sheets

(56) References Cited

U.S. PATENT DOCUMENTS

| | | | | |
|---|---|---|---|---|
| 2009/0260391 | A1* | 10/2009 | Shioyama | F24F 1/30 62/531 |
| 2011/0314861 | A1* | 12/2011 | Kim | F24F 1/32 62/426 |
| 2014/0318173 | A1* | 10/2014 | Koike | F24F 1/56 62/426 |
| 2017/0115012 | A1* | 4/2017 | Kim | F24F 1/16 |
| 2019/0203955 | A1* | 7/2019 | Kobayashi | F24F 1/46 |
| 2019/0203957 | A1* | 7/2019 | Kobayashi | F24F 13/20 |
| 2019/0203988 | A1* | 7/2019 | Kobayashi | F25B 41/003 |
| 2020/0056804 | A1* | 2/2020 | Benefield | F24F 13/20 |

* cited by examiner

HEAT SOURCE UNIT FOR REFRIGERATION APPARATUS

TECHNICAL FIELD

A heat source unit for a refrigeration apparatus, provided with a fan that horizontally blows out air passing through a heat exchanger.

BACKGROUND

Conventionally, there have been heat source units for refrigeration apparatuses in which fans that horizontally blow out air passing through heat exchangers are provided to internal spaces, as shown in Patent Literature 1 (Japanese Laid-open Patent Publication No. 2009-24903). A shut-off valve and a shut-off valve cover are provided to a side surface of the heat source unit so as to protrude sideways.

In the conventional heat source unit described above, operation of the shut-off valve and other work cannot be performed without taking the shut-off valve cover off from the side surface of the heat source unit.

SUMMARY

A heat source unit for a refrigeration apparatus according to one or more embodiments comprises a casing, a heat exchanger that performs heat exchange between a refrigerant and air, a fan that horizontally blows out air passing through the heat exchanger, and at least one shut-off valve. The heat exchanger and the fan are placed in an internal space of the casing. The shut-off valve has a connection port that opens toward a front-surface side or a rear-surface side of the casing. The shut-off valve is placed so as not to protrude from a virtual cuboid defined by a top surface, bottom surface, front surface, rear surface, left-side surface, and right-side surface of the casing. Peripheral panels, which form the front surface, rear surface, left-side surface, and right-side surface of the casing, are cut-out in one part of a first portion that forms whichever of the left-side surface and the right-side surface of the casing that is closer to the shut-off valve. The heat source unit does not have a member that covers a cut-out portion of the first portion.

In one or more embodiments, because the shut-off valve can be accessed through the cut-out portion formed in the first portion of the casing without taking off a shut-off valve cover or similar member provided so as to protrude sideways from the side surface of the casing, work such as the operation of the shut-off valve can be performed easily.

According to one or more embodiments of a heat source unit for a refrigeration apparatus, the peripheral panels are cut out in part of a second portion that forms whichever of the front surface and the rear surface of the casing that is closer to the connection port. A cut-out portion of the second portion is continuous with the cut-out portion of the first portion.

In one or more embodiments, because the connection port of the shut-off valve can be accessed through the cut-out portion formed across the first portion and the second portion of the casing, the work of connecting a refrigerant connection pipe to the shut-off valve can be performed easily.

According to one or more embodiments of a heat source unit for a refrigeration apparatus, the peripheral panels have a first peripheral panel that forms both the first portion and the second portion.

According to one or more embodiments of a heat source unit for a refrigeration apparatus, the peripheral panels have a second peripheral panel that forms the first portion, and a third peripheral panel that forms the second portion.

According to one or more embodiments of a heat source unit for a refrigeration apparatus, the heat source unit further has a space-forming member that is provided to the casing and that partitions the internal space of the casing and a shut-off valve placement space in which the shut-off valve is placed. The cut-out portion of the first portion faces the shut-off valve placement space.

In one or more embodiments, the shut-off valve placement space can be accessed through the cut-out portion of the first portion, and work such as the operation of the shut-off valve can be performed easily.

According to one or more embodiments of a heat source unit for a refrigeration apparatus, the space-forming member has a shut-off valve support member that supports the shut-off valve.

According to one or more embodiments of a heat source unit for a refrigeration apparatus, the shut-off valve support member is positioned between the rear surface of the casing and the shut-off valve when the connection port opens toward the front-surface side of the casing, and the shut-off valve support member is positioned between the front surface of the casing and the shut-off valve when the connection port opens toward the rear-surface side of the casing.

In one or more embodiments, the internal space of the casing and the shut-off valve placement space can be partitioned in the front-rear direction by the shut-off valve support member.

According to one or more embodiments of a heat source unit for a refrigeration apparatus, the space-forming member has an above-shut-off-valve member positioned above the shut-off valve.

In one or more embodiments, the internal space of the casing and the shut-off valve placement space can be vertically partitioned by the above-shut-off-valve member.

DETAILED DESCRIPTION

Below is a description, made with reference to the drawings, of a heat source unit for a refrigeration apparatus according to one or more embodiments.

(1) Configuration of Air Conditioning Apparatus

Figure 1:
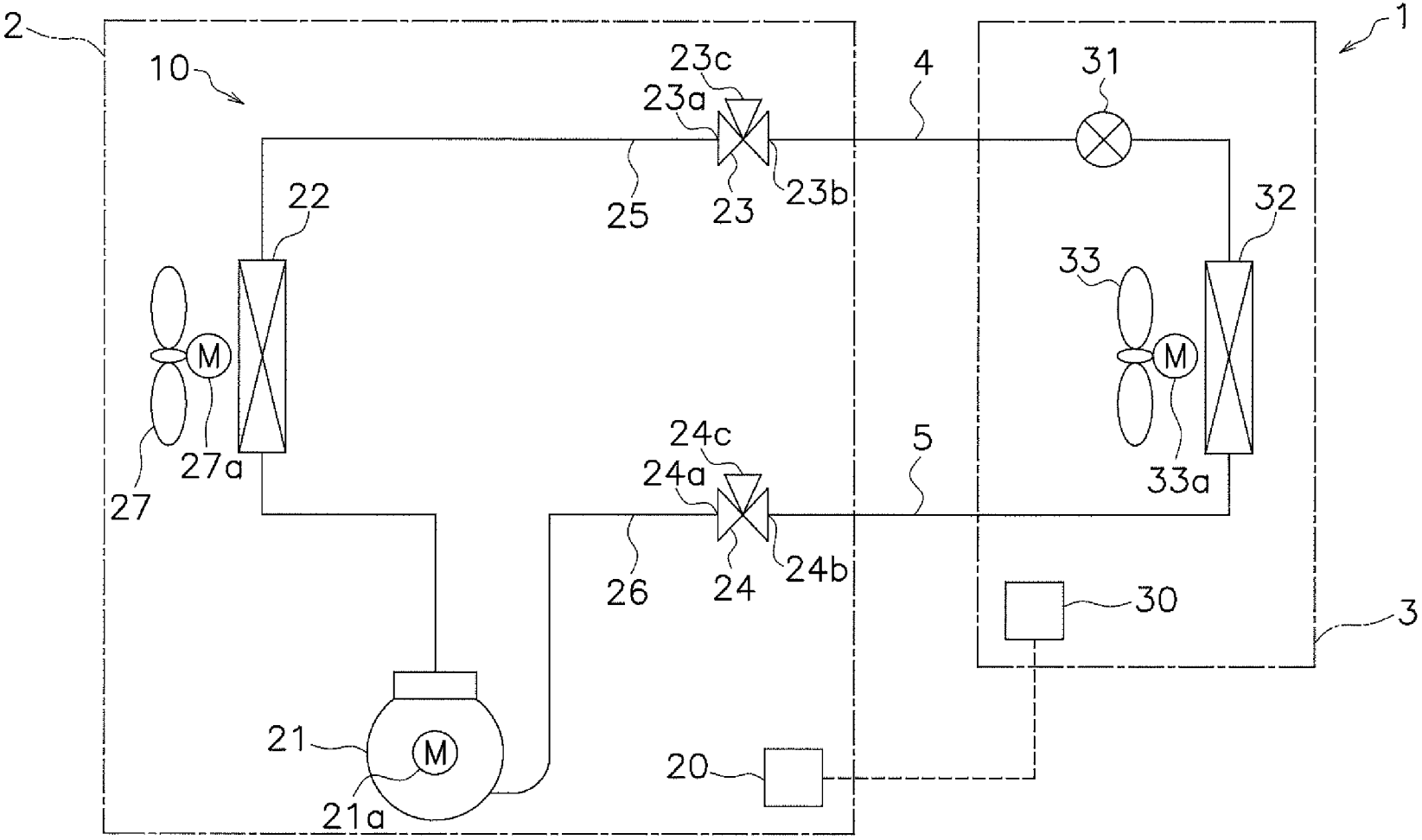
FIG. 1 is a schematic configuration diagram of an air conditioning apparatus serving as a refrigeration apparatus that employs an outdoor unit serving as a heat source unit according to one or more embodiments of the present invention.

FIG. 1 is a schematic configuration diagram of an air conditioning apparatus 1 serving as a refrigeration apparatus that employs an outdoor unit 2 serving as a heat source unit according to one or more embodiments of the present invention.

<Overall>

The air conditioning apparatus 1 as a refrigeration apparatus is able to perform cooling of a room in a building, etc., by performing a vapor-compression refrigeration cycle. The air conditioning apparatus 1 mainly has the outdoor unit 2 serving as a heat source unit, an indoor unit 3 serving as a usage unit, and a liquid refrigerant connection pipe 4 and gas refrigerant connection pipe 5 that connect the outdoor unit 2 and the indoor unit 3. A vapor-compression refrigeration circuit 10 of the air conditioning apparatus 1 is configured by the outdoor unit 2 and the indoor unit 3 being connected via the refrigerant connection pipes 4, 5.

<Indoor Unit>

The indoor unit 3 is installed in a building. The indoor unit 3, as described above, is connected to the outdoor unit 2 via the liquid refrigerant connection pipe 4 and the gas refrigerant connection pipe 5, thus configuring part of the refrigeration circuit 10. The indoor unit 3 mainly has an indoor expansion valve 31 and an indoor heat exchanger 32.

The indoor expansion valve 31 is an electric expansion valve that, when in operation, adjusts the flow rate of refrigerant flowing through the indoor heat exchanger 32 while decompressing the refrigerant to a low pressure in the refrigeration cycle, and is connected between the liquid refrigerant connection pipe 4 and a liquid-side end of the indoor heat exchanger 32.

The indoor heat exchanger 32 is a heat exchanger that, when in operation, functions as an evaporator of refrigerant at a low pressure in the refrigeration cycle and cools indoor air. The liquid-side end of this indoor heat exchanger is connected to the indoor expansion valve 31, and a gas-side end is connected to the gas refrigerant connection pipe 5.

The indoor unit 3 has an indoor fan 33 for drawing indoor air into the indoor unit 3, and supplying air passing through the indoor heat exchanger 32 as supply air into the room after the air has exchanged heat with the refrigerant in the indoor heat exchanger 32. Specifically, the indoor unit 3 has an indoor fan 33 as a fan that supplies the indoor heat exchanger 32 with indoor air serving as a heat source for the refrigerant flowing through the indoor heat exchanger 32. The indoor fan 33 is driven by an indoor fan motor 33*a*.

Furthermore, the indoor unit 3 has an indoor-side electric component assembly 30 that functions as an indoor-side control part to control the actions of the components configuring the indoor unit 3. The indoor-side electric component assembly 30 has a control board and other electric components, and this assembly is designed to be capable of communicating through control signals, etc., with the outdoor unit 2.

<Outdoor Unit>

The outdoor unit 2 is installed on the outside of the building. The outdoor unit 2, as described above, is connected to the indoor unit 3 via the liquid refrigerant connection pipe 4 and the gas refrigerant connection pipe 5, thus configuring part of the refrigeration circuit 10. The outdoor unit 2 mainly has a compressor 21, an outdoor heat exchanger 22, a liquid-side shut-off valve 23 serving as a first shut-off valve, and a gas-side shut-off valve 24 serving as a second shut-off valve.

The compressor 21 is a device that, when in operation, compresses refrigerant at a low pressure in the refrigeration cycle to a high pressure. In one or more embodiments, a compressor having a hermetically sealed structure, in which a positive displacement compression element (not shown) is rotatably driven by a compressor motor 21*a*, is employed as the compressor 21. A discharge-side end of the compressor 21 is connected to a gas-side end of the outdoor heat exchanger 22, and an intake-side end of the compressor 21 is connected to the gas-side shut-off valve 24. In one or more embodiments, the intake-side end of the compressor 21 and the gas-side shut-off valve 24 are connected by an outdoor-side gas refrigerant pipe 26.

The outdoor heat exchanger 22 is a heat exchanger that, when in operation, functions as a radiator for refrigerant at a high pressure in the refrigeration cycle. The gas-side end of this outdoor heat exchanger is connected to the discharge-side end of the compressor 21, and a liquid-side end is connected to the liquid-side shut-off valve 23. In one or more embodiments, the liquid-side end of the outdoor heat exchanger 22 and the liquid-side shut-off valve 23 are connected by an outdoor-side liquid refrigerant pipe 25.

The liquid-side shut-off valve 23 and the gas-side shut-off valve 24 are manual valves provided to parts connecting with external devices or pipes (specifically, the liquid refrigerant connection pipe 4 and the gas refrigerant connection pipe 5). In the liquid-side shut-off valve 23, an outdoor-side connection port 23*a*, which is on an outdoor-side end of the valve, is connected to the outdoor-side liquid refrigerant pipe 25, and an indoor-side connection port 23*b*, which is on an indoor-side end, is connected to the liquid refrigerant connection pipe 4. In the gas-side shut-off valve 24, an outdoor-side connection port 24*a*, which is on an outdoor-side end of the valve, is connected to the outdoor-side gas refrigerant pipe 26, and an indoor-side connection port 24*b*, which is on an indoor-side end, is connected to the gas refrigerant connection pipe 5. The liquid-side shut-off valve 23 and the gas-side shut-off valve 24 are respectively provided with service ports 23*c*, 24*c* to which a charge hose is connected to fill refrigerant.

The outdoor unit 2 has an outdoor fan 27 for drawing outdoor air into the outdoor unit 2, and blowing the air passing through the outdoor heat exchanger 22 out of the room after the air has exchanged heat with the refrigerant in the outdoor heat exchanger 22. Specifically, the outdoor unit 2 has the outdoor fan 27 as a fan that supplies the outdoor heat exchanger 22 with outdoor air serving as a cooling source for the refrigerant flowing through the outdoor heat exchanger 22. The outdoor fan 27 is driven by an outdoor fan motor 27*a*.

Furthermore, the outdoor unit 2 has an outdoor-side electric component assembly 20 that functions as an outdoor-side control part to control the actions of the components configuring the outdoor unit 2. The outdoor-side electric component assembly 20 has a control board and other electric components, and this assembly is designed to be capable of communicating through control signals, etc., with the indoor unit 3 (the indoor-side electric component assembly 30 in one or more embodiments).

<Refrigerant Connection Pipes>

The refrigerant connection pipes 4, 5 are constructed on-site when the air conditioning apparatus 1 is installed in a building or another installation site. One end of the liquid refrigerant connection pipe 4 is connected to the indoor-side connection port 23*b* of the liquid-side shut-off valve 23 of the outdoor unit 2, and the other end of the liquid refrigerant connection pipe 4 is connected to the indoor expansion valve 31 of the indoor unit 3. One end of the gas refrigerant connection pipe 5 is connected to the indoor-side connection port 24*b* of the gas-side shut-off valve 24 of the outdoor unit 2, and the other end of the gas refrigerant connection pipe 5 is connected to a gas-side end of the indoor heat exchanger 32 of the indoor unit 3.

(2) Configuration of Outdoor Unit

Figure 2:
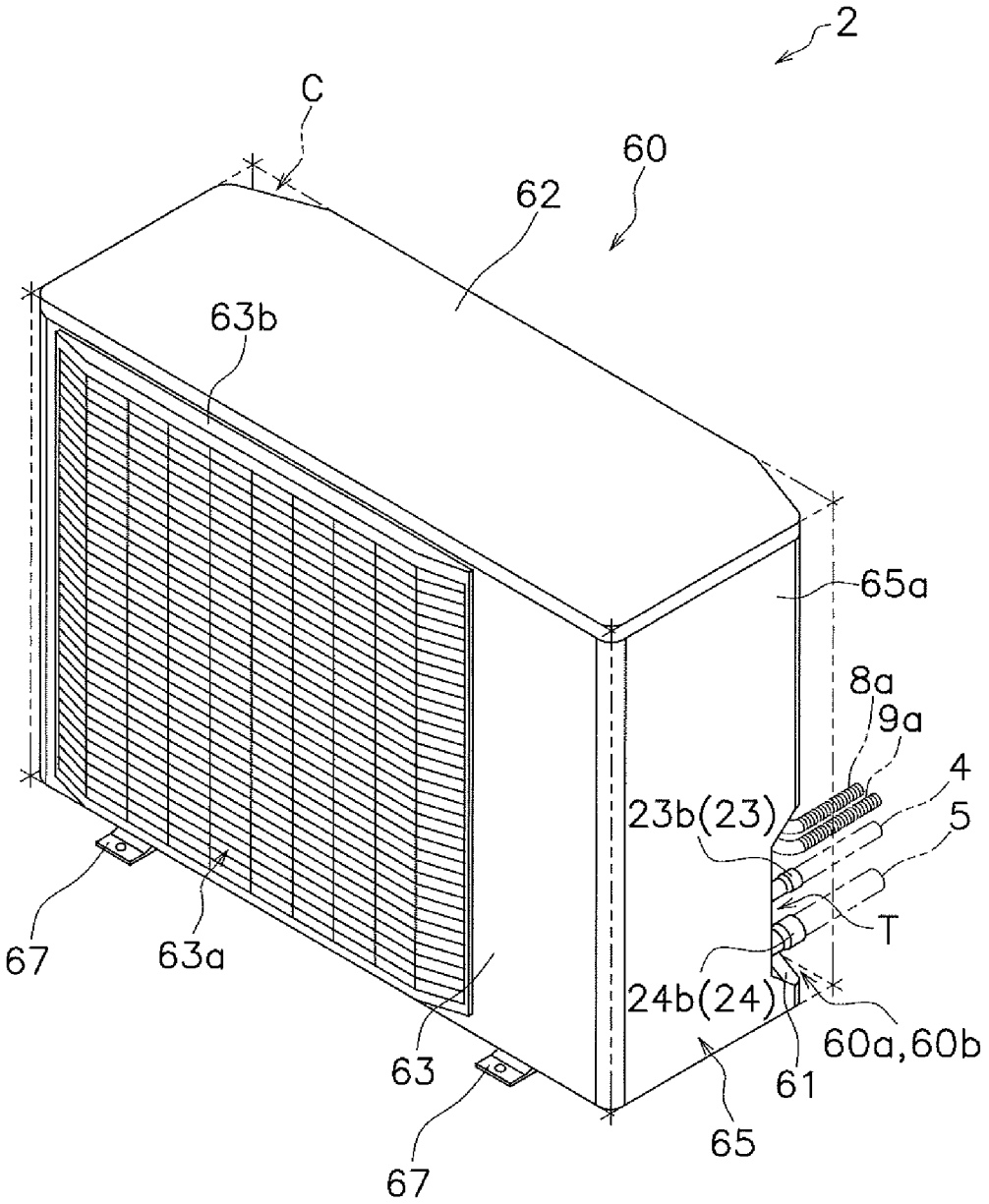
FIG. 2 is a perspective view showing an external view of the outdoor unit.
Figure 3:
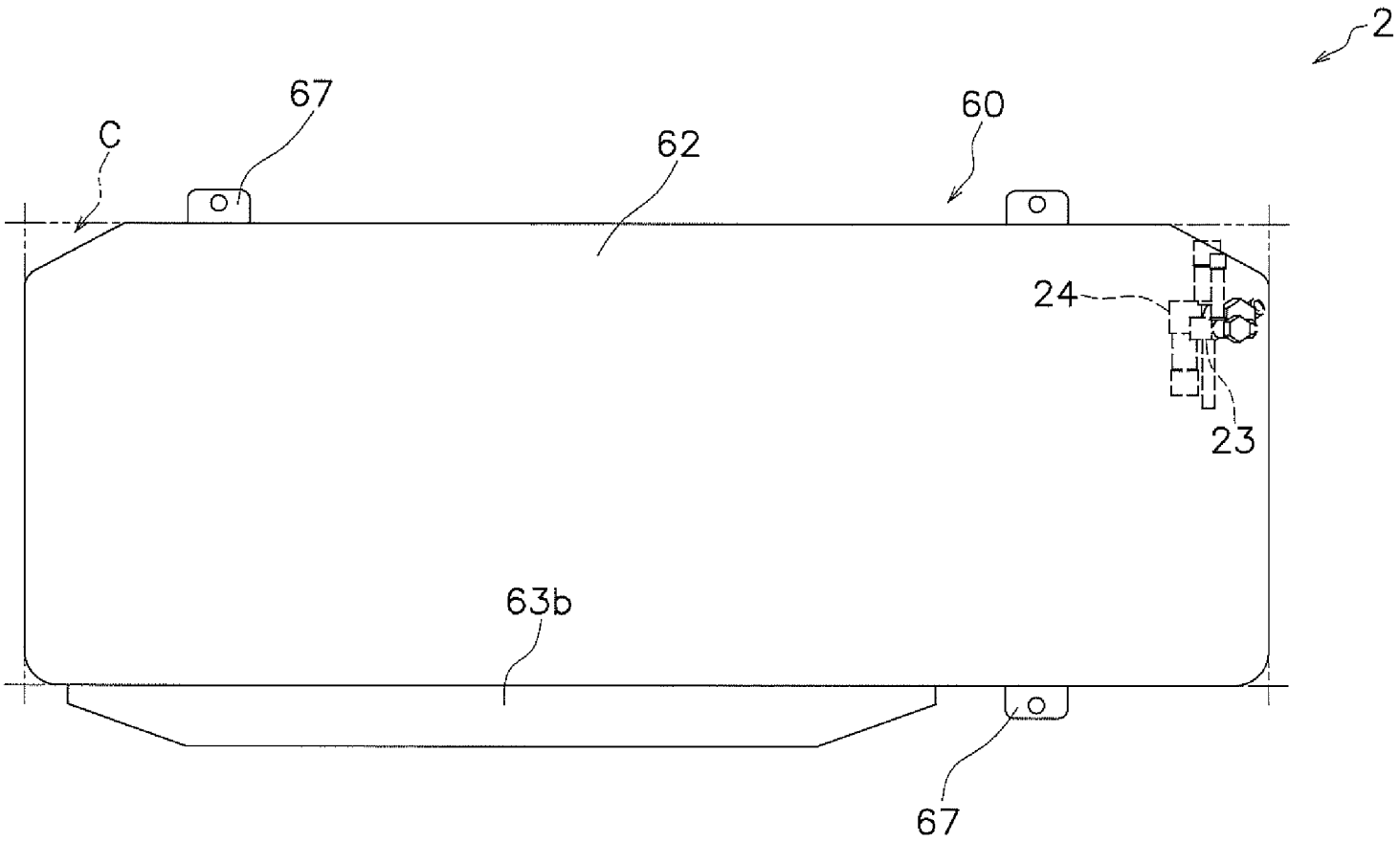
FIG. 3 is a plan view of the outdoor unit (with a shut-off valve depicted in dashed lines)
Figure 4:
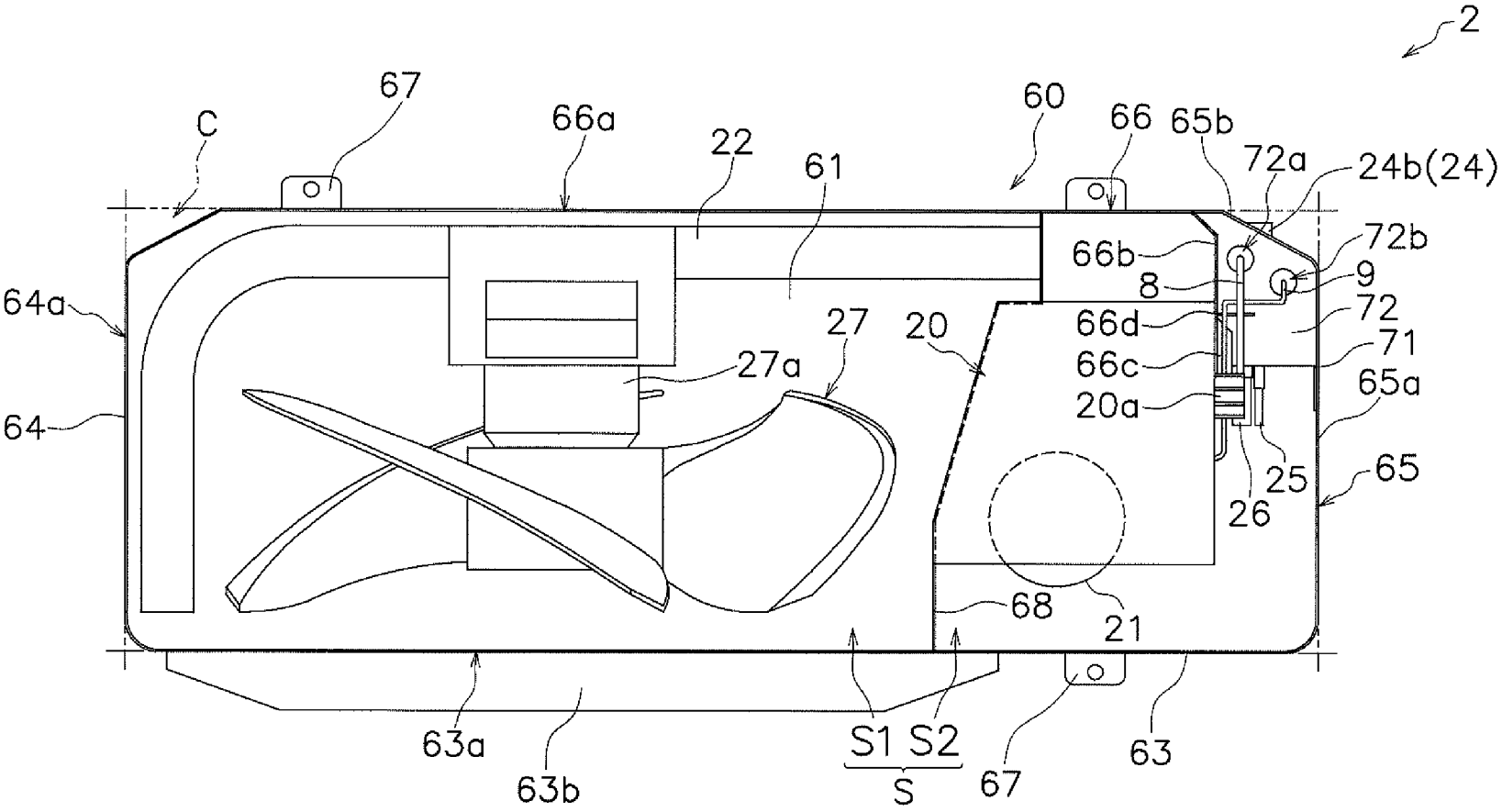
FIG. 4 is a plan view of the outdoor unit (with a top panel taken off)
Figure 5:
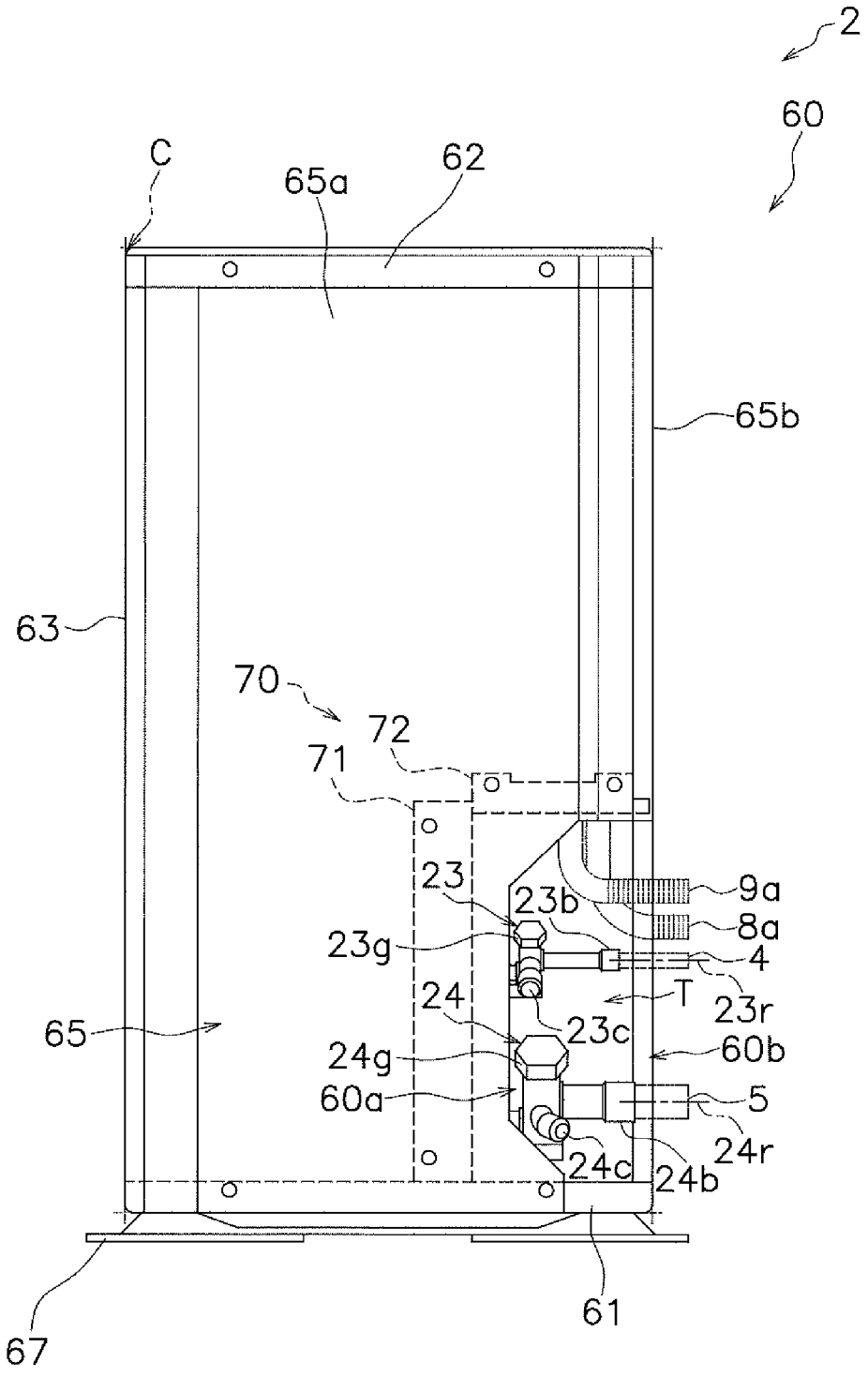
FIG. 5 is a right-side surface view of the outdoor unit.
Figure 6:
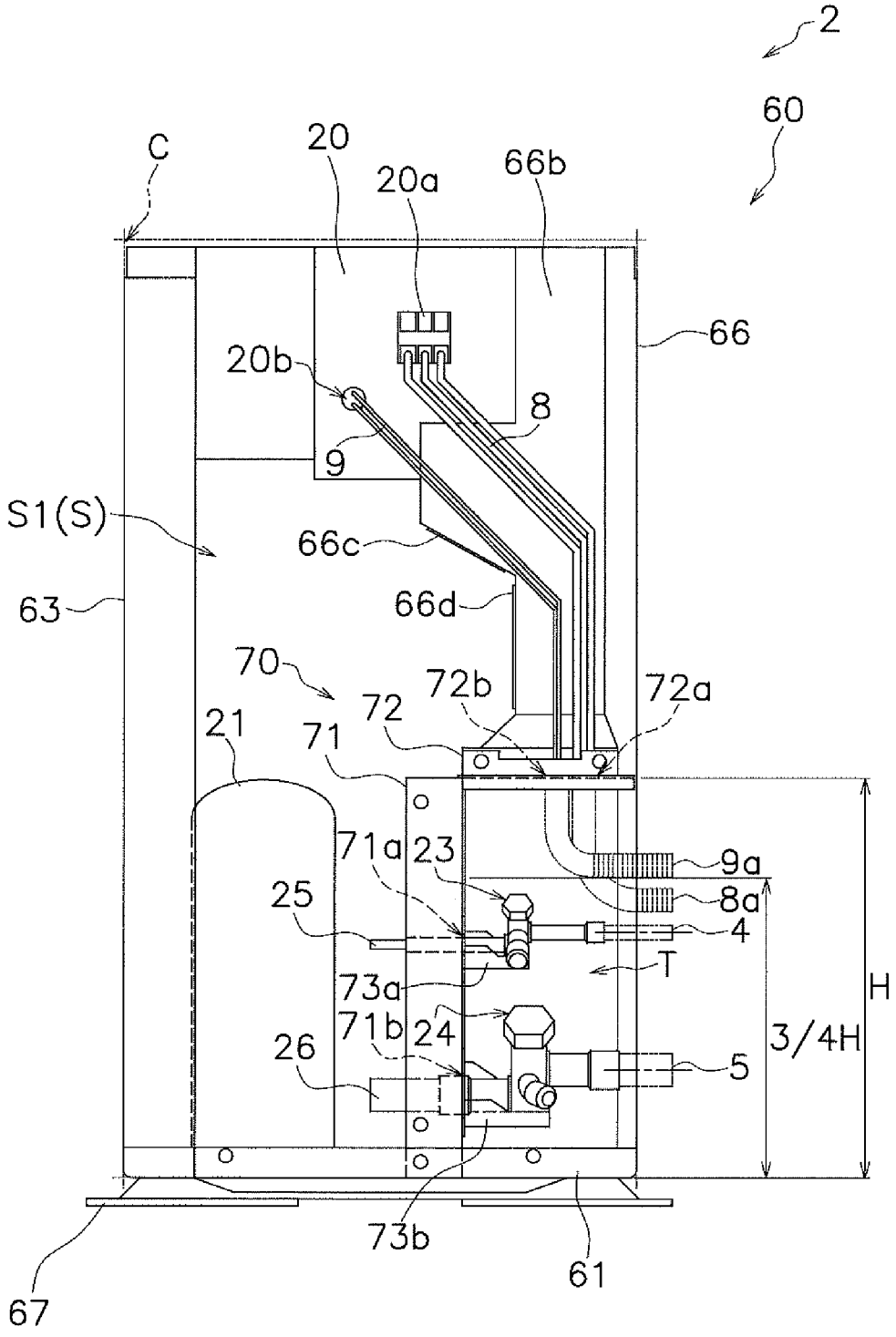
FIG. 6 shows the outdoor unit with the top panel and a right-side panel removed from the unit as depicted in FIG. 5.
Figure 7:
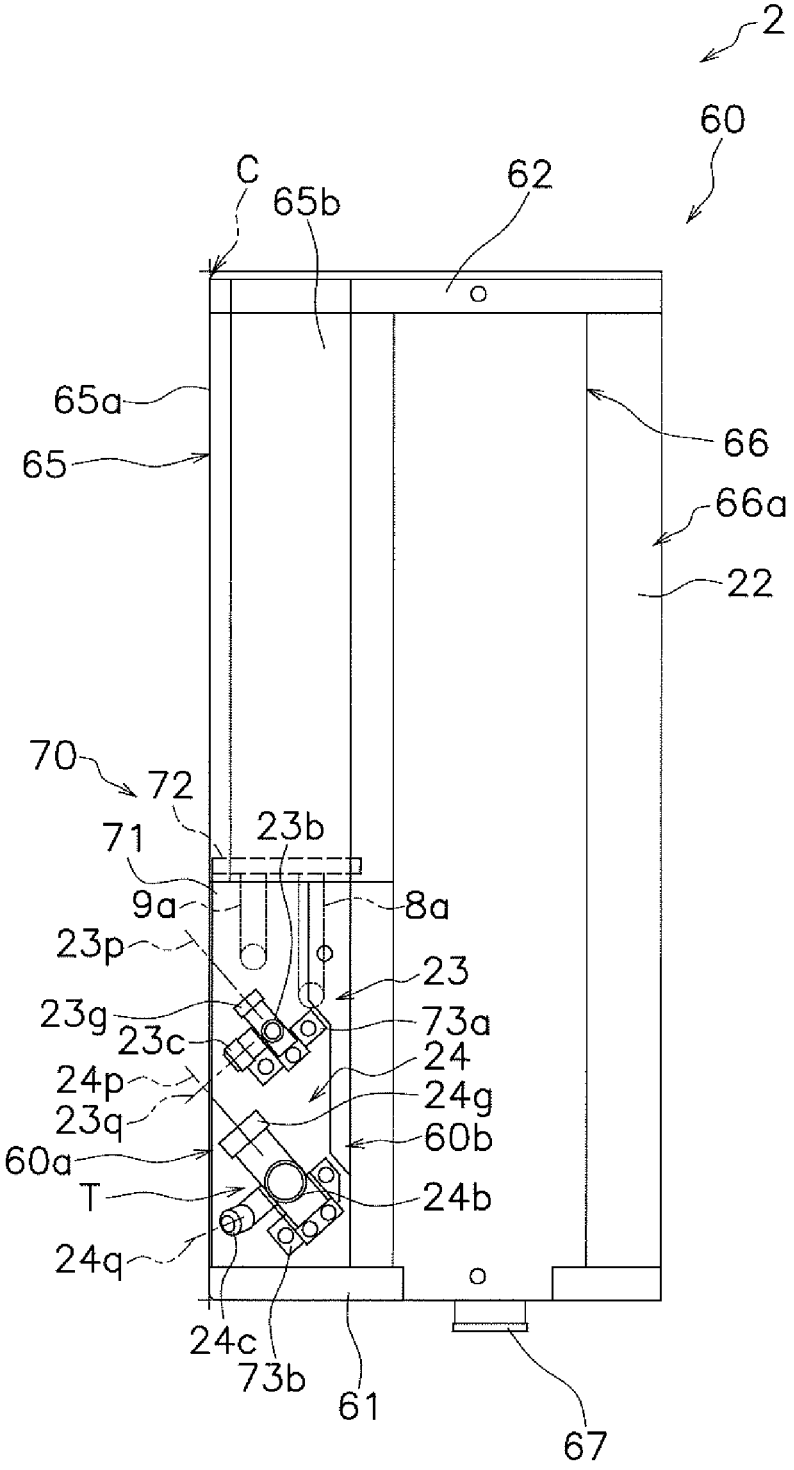
FIG. 7 is a rear view of the outdoor unit (showing only the portion near the right-side surface)
Figure 8:
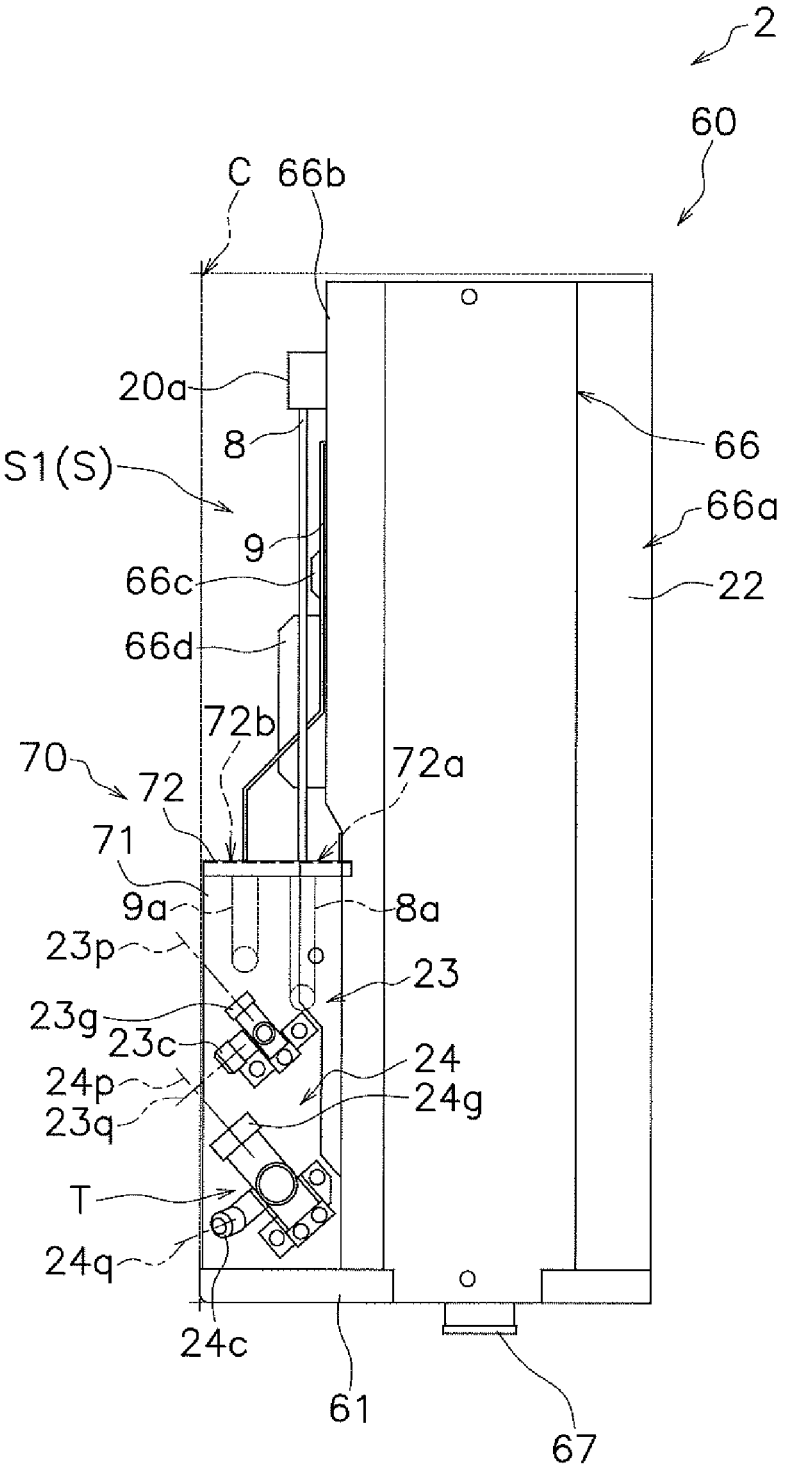
FIG. 8 shows the outdoor unit with the top panel and the right-side panel removed from the unit as depicted in FIG. 7.
Figure 9:
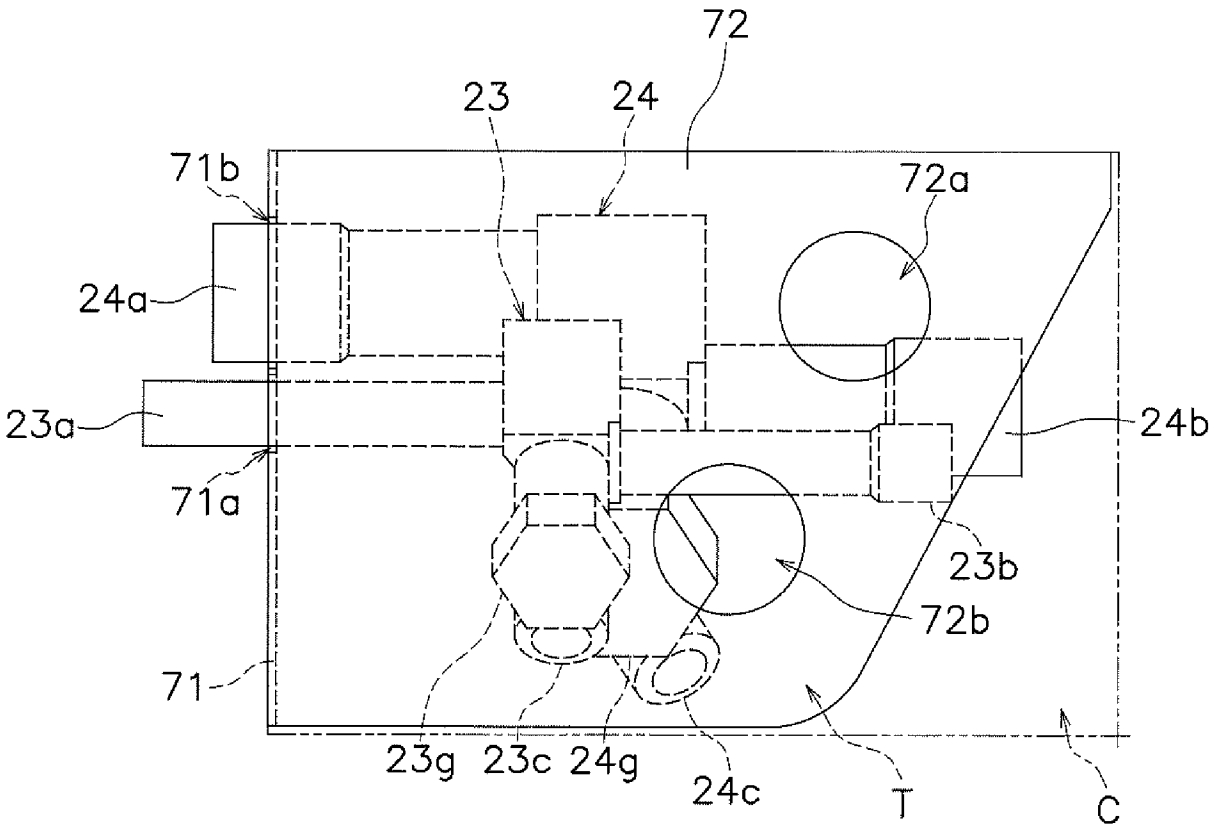
FIG. 9 shows the positional relationship between wiring holes and shut-off valves in a plan view of a casing according to one or more embodiments.
Figure 10:
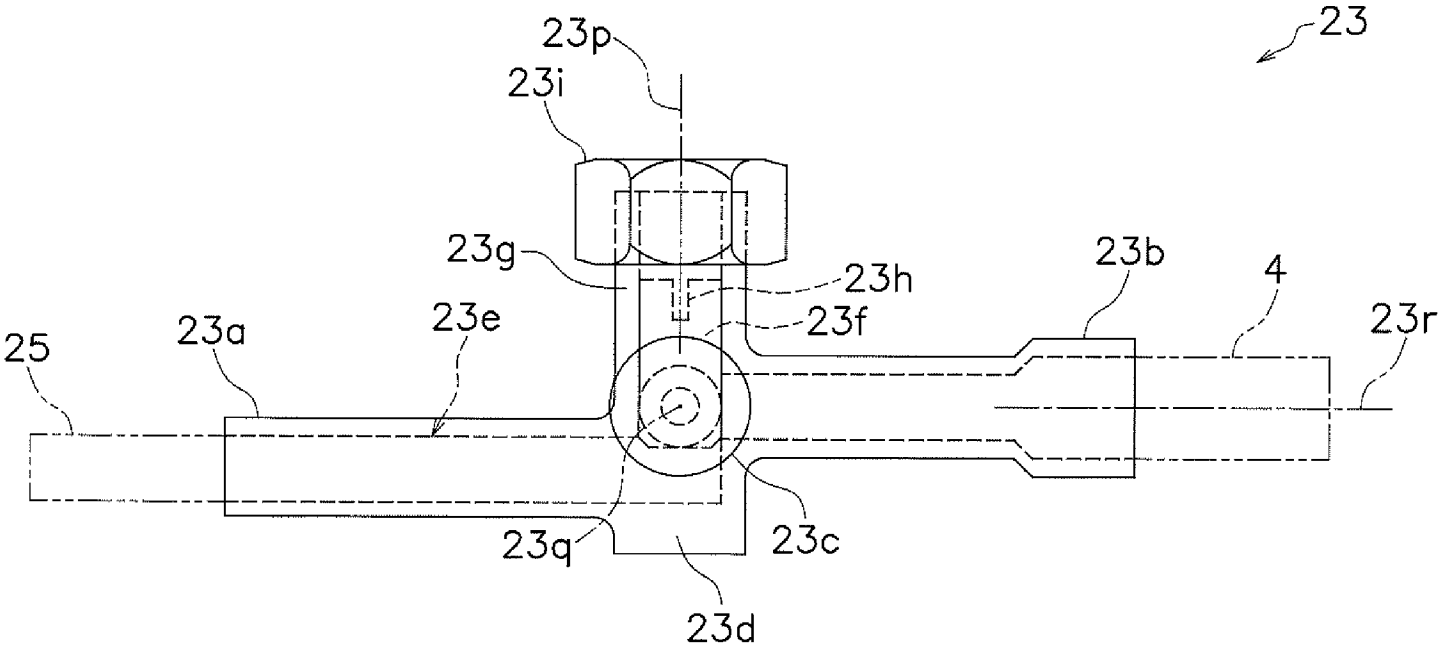
FIG. 10 shows a shut-off valve (with a valve-operating part facing upward) according to one or more embodiments.

FIG. 2 is a perspective view showing an external view of the outdoor unit 2. FIG. 3 is a plan view of the outdoor unit 2 (with the shut-off valves 23, 24 shown in dashed lines). FIG. 4 is a plan view of the outdoor unit 2 (with a top-surface panel 62 removed). FIG. 5 is a right-side view of the outdoor unit 2. FIG. 6 shows the outdoor unit with the top-surface panel 62 and a right-side panel 65 removed from the unit as depicted in FIG. 5. FIG. 7 is a rear view of the outdoor unit 2 (showing only the portion near the right side). FIG. 8 shows the outdoor unit with the top-surface panel 62 and the right-side panel 65 removed from the unit as depicted in FIG. 7. FIG. 9 shows the positional relationship between wiring holes 72*a*, 72*b* and the shut-off valves 23, 24 in a plan view of a casing 60. FIG. 10 shows the liquid-side shut-off valve 23 (with a valve-operating part 23*g* facing upward). In the following description, the terms "up," "down," "left," "right," "front," "rear," "lateral," "top surface," "bottom surface," "front surface," and "back surface," unless otherwise specified, refer to directions and/or surfaces assuming that the "front surface" is the left-diagonal-facing surface of the outdoor unit 2 shown in FIG. 2.

<Basic Configuration>

First, the basic configuration of the outdoor unit 2 shall be described.

The outdoor unit 2 is a heat source unit with a structure (a "trunk-type structure") having the substantially cuboid box-shaped casing 60, the outdoor heat exchanger 22 serving as a heat exchanger that is placed in an internal space S of the casing 60 and that performs heat exchange between the refrigerant and air, and the outdoor fan 27 serving as a fan that is placed in the internal space S of the casing 60 and that horizontally blows out air passing through the outdoor heat exchanger 22. The outdoor unit 2 mainly has: the casing 60; the outdoor fan 27; refrigerant circuit structural components that configure part of the refrigeration circuit 10, including the compressor 21, the outdoor heat exchanger 22, and/or other devices, the shut-off valves 23, 24 and other valves, and the refrigerant pipes 25, 26 and other refrigerant pipes; and the outdoor-side electric component assembly 20.

The casing 60 mainly has a bottom-surface panel 61, the top-surface panel 62, and peripheral panels (front-surface panel 63, left-side panel 64, right-side panel 65, and back-surface panel 66) forming the front surface, back surface, left-side surface, and right-side surface of the casing 60.

The bottom-surface panel 61 is a laterally extending panel-shaped member forming the bottom surface of the casing 60. In a plan view of the casing 60, the bottom-surface panel 61 has a rectangular shape in which the left-rear corner and the right-rear corner are chamfered. A lower surface of the bottom-surface panel 61 is provided with a fixing leg 67 fixed to an on-site installation surface.

The top-surface panel 62 is a laterally extending panel-shaped member forming a top surface of the casing 60. In a plan view of the casing 60, the top-surface panel 62, similar to the bottom-surface panel 61, has a rectangular shape in which the left-rear corner and the right-rear corner are chamfered. The top-surface panel 62 is fixed by screws, etc., to the front-surface panel 63, the left-side panel 64, the right-side panel 65, and the back-surface panel 66.

The front-surface panel 63 is one peripheral panel of the casing 60. The front-surface panel 63 is a panel-shaped member forming a front surface of the casing 60, a portion on the front-surface-side end of the left-side surface, and a portion on the front-surface-side end of the right-side surface. A lower part of the front-surface panel 63 is fixed by screws, etc., to the bottom-surface panel 61. A portion near the left-side surface of the front-surface panel 63 is provided with a blow-out port 63*a* for blowing out to the exterior air that has been taken into the internal space S from the back-surface and left-side surface of the casing 60 by the outdoor fan 27. A fan grill 63*b* is provided to the blow-out port 63*a*.

The left-side panel 64 is a panel-shaped member forming the left-side surface (excluding the portion on the front-surface-side end of the left-side surface in one or more embodiments) of the casing 60 and the left-side-surface end of the back surface, thus configuring part of the peripheral panels of the casing 60. A lower part of the left-side panel 64 is fixed by screws, etc., to the bottom-surface panel 61. In the left-side panel 64 is formed an intake port 64*a* for air taken into the internal space S of the casing 60 by the outdoor fan 27.

The right-side panel 65 is a panel-shaped member forming the right-side surface (excluding the portion on the front-surface-side end of the right-side surface in one or more embodiments) of the casing 60 and the right-side-surface end of the back surface, thus configuring part of the peripheral panels of the casing 60. A lower part of the right-side panel 65 is fixed by screws, etc., to the bottom-surface panel 61.

The back-surface panel 66 is a panel-shaped member forming the back surface (excluding the right-side-surface end portion and near-left-side-surface portion of the back surface) of the casing 60, thus configuring part of the peripheral panels of the casing 60. A lower part of the back-surface panel 66 is fixed by screws, etc., to the bottom-surface panel 61. In the back-surface panel 66 is formed an intake port 66*a* for air taken into the internal space S of the casing 60 by the outdoor fan 27.

A partitioning panel 68 is provided inside the casing 60. The partitioning panel 68 is a panel-shaped member extending vertically and in the front-rear direction over the bottom-surface panel 61, and is disposed so as to partition the internal space S of the casing 60 into two left and right spaces (fan compartment S1, machinery compartment S2). In a plan view of the casing 60, the partitioning panel 68 extends toward the back-surface side from a right-side portion of the blow-out port 63*a* of the front-surface panel 63, and reaches a right-end part of the substantially L-shaped outdoor heat exchanger 22, which is disposed so as to extend along the back surface from the left-side surface of the casing 60. A lower part of the partitioning panel 68 is fixed by screws, etc., to the bottom-surface panel 61, a front part is fixed by screws, etc., to the front-surface panel 63, and a rear part is fixed by screws, etc., to the right-end part of the outdoor heat exchanger 22.

The compressor 21 is in the shape of an upright cylinder, and is disposed in the machinery compartment S2. The compressor 21 is provided over the bottom-surface panel 61.

In a plan view of the casing 60, the outdoor heat exchanger 22 is substantially L-shaped, and is disposed in the fan compartment S1. The outdoor heat exchanger 22 is provided over the bottom-surface panel 61 so as to extend along the back surface from the left-side surface of the casing 60.

The outdoor fan 27 is a propeller fan and is disposed in the fan compartment S1. The outdoor fan 27 is provided so as to face the blow-out port 63*a* in a front side of the outdoor heat exchanger 22. The outdoor fan motor 27*a* is provided between the outdoor fan 27 and the outdoor heat exchanger 22 in the front-rear direction.

The outdoor-side electric component assembly 20 is a component in which the control board and other electric components are assembled, and is disposed in the machinery compartment S2. The outdoor-side electric component assembly 20 is provided in an upper part of the machinery compartment S2.

Though not depicted in FIGS. 4, 6, and 8, refrigeration circuit structural components other than the compressor 21, the outdoor heat exchanger 22, and the shut-off valves 23, 24 are also disposed in the internal space S of the casing 60.

<Shut-Off Valves and Structures of Peripheries Thereof)

Next, the shut-off valves 23, 24 of the outdoor unit 2 and the structures of the peripheries thereof shall be described.

The liquid-side shut-off valve 23 mainly has a valve main body 23*d* in which is formed a flow channel 23*e* through which refrigerant flows, a valve body 23*f* that opens and closes the flow channel 23*e*, and a valve-operating part 23*g* that operates the valve body 23*f*. Specifically, using as a reference a state in which the valve-operating part 23*g* faces upward, formed in the valve main body 23*d* are the substantially horizontally facing flow channel 23*e*, the outdoor-side connection port 23*a*, which is an opening corresponding to one end of the flow channel 23*e*, and the indoor-side connection port 23*b*, which is an opening corresponding to the other end of the flow channel 23*e*. Also provided to the valve main body 23*d* are the valve-operating part 23*g*, which protrudes upward from some point in the flow channel 23*e*, and a service port 23*c*, which protrudes in a direction intersecting the flow channel 23*e* and the valve-operating part 23*g*. The valve body 23*f* is threaded into the valve-operating part 23*g* so as to be capable of moving vertically. In an upper end of the valve body 23*f* is formed an engaging part 23*h*, which is composed of a concaved portion or groove into which a hexagonal wrench, a driver, or another tool fits. A valve cover 23*i* is detachably threaded into the valve-operating part 23*g*. A tip end of the service port 23*c* serves as a nozzle part to which a charge hose, etc., can be connected. A center line of the valve-operating part 23*g* is denoted as 23*p*, a center line of the service port 23*c* is denoted as 23*q*, and a center line of the indoor-side connection port 23*b* is denoted as 23*r*.

The gas-side shut-off valve 24 is larger in diameter than the liquid-side shut-off valve 23, and is similar in structure to the liquid-side shut-off valve 23. Therefore, for the structure of the gas-side shut-off valve 24, the symbols 23*a* to 23*i* and 23*p* to 23*r*, which indicate the components of the liquid-side shut-off valve 23, are replaced with the symbols 24*a* to 24*i* and 24*p* to 24*r*, and descriptions of these components are omitted.

The liquid-side shut-off valve 23 and the gas-side shut-off valve 24 are disposed so as not to protrude from a virtual cuboid C defined by the top surface, bottom surface, front surface, back surface, left-side surface, and right-side surface of the casing 60. In one or more embodiments, the virtual cuboid C is a cuboid-shaped spatial area formed by surfaces virtually extending in the front-rear and lateral directions through the top surface and bottom surface of the casing 60 (in one or more embodiments, surfaces extending without regard to the chamfering of the corners at the left-rear sides and the corners at the right-rear sides of the top surface and bottom surface of the casing 60), surfaces virtually extending in the vertical and lateral directions through the front surface and back surface of the casing 60, and surfaces virtually extending in the vertical and front-rear directions through the left-side surface and right-side surface of the casing 60.

The liquid-side shut-off valve 23 and the gas-side shut-off valve 24 are disposed in a near-back-surface portion of the right-side surface of the casing 60, with the openings of the indoor-side connection ports 23*b*, 24*b* facing toward the back surface of the casing 60. Specifically, the liquid-side shut-off valve 23 and the gas-side shut-off valve 24 are disposed in portions of the casing 60 that are in proximity to the right-side panel 65, which forms the near-back-surface portion of the right-side surface.

The right-side panel 65 has parts cut out in proximity to the liquid-side shut-off valve 23 and the gas-side shut-off valve 24. Specifically, a lower part 60*a* near the back surface of a first portion 65*a* is cut out, this first portion 65*a* being a portion in the right-side panel 65 that forms the right-side surface of the casing 60. A lower part 60*b* near the right-side surface of a second portion 65*b* is also cut out, this second portion 65*b* being a portion in the right-side panel 65 that forms the back surface of the casing 60. The cut-out portion 60*b* of the second portion 65*b* is continuous with the cut-out portion 60*a* of the first portion 65*a*. Specifically, the right-side panel 65 is a first peripheral panel forming both the first portion 65*a*, which forms the right-side surface of the casing 60, and the second portion 65*b*, which forms the back surface of the casing 60. The cut-out portions 60*a*, 60*b* are formed from the right-side surface to the back surface in a lower part of a right-rear-side corner of the right-side panel 65 serving as a first peripheral panel. The casing 60 does not have a member covering the cut-out portions 60*a*, 60*b* of the right-side panel 65, and after the outdoor unit 2 has been installed on-site, the liquid-side shut-off valve 23 and the gas-side shut-off valve 24 can be seen through the cut-out portions 60*a*, 60*b* without taking any members off of the casing 60.

The casing 60 is further provided with a space-forming member 70 that partitions the internal space S of the casing 60 and a shut-off valve placement space T in which the liquid-side shut-off valve 23 and the gas-side shut-off valve 24 are placed. The cut-out portions 60*a*, 60*b* of the right-side panel 65 face the shut-off valve placement space T. Specifically, the casing 60 is cut out in the portion that faces the shut-off valve placement space T.

The space-forming member 70 mainly has a shut-off valve support member 71 positioned between the front surface of the casing 60 and the liquid-side shut-off valve 23 and gas-side shut-off valve 24 in the front-rear direction, and an above-shut-off-valve member 72 positioned above the liquid-side shut-off valve 23 and the gas-side shut-off valve 24.

The shut-off valve support member 71 is a panel-shaped member that supports the liquid-side shut-off valve 23 and the gas-side shut-off valve 24 at a position that is nearer to the front surface than the cut-out portion 60*a* of the first portion 65*a* of the right-side panel 65. Additionally, the shut-off valve support member 71 partitions in the front-rear direction the internal space S of the casing 60 and the shut-off valve placement space T in which the liquid-side shut-off valve 23 and the gas-side shut-off valve 24 are placed. A lower part of the shut-off valve support member 71 is fixed by screws, etc., to the bottom-surface panel 61, and a right-side part is fixed by screws, etc., to the right-side panel 65.

Formed in the shut-off valve support member 71 are a hole 71*a* through which the outdoor-side connection port 23*a* of the liquid-side shut-off valve 23 penetrating in the front-rear direction, and a hole 71*b* through which the outdoor-side connection port 24*a* of the gas-side shut-off valve 24 penetrating in the front-rear direction. The liquid-side shut-off valve 23 and the gas-side shut-off valve 24 are supported on the shut-off valve support member 71 via brackets 73*a*, 73*b* extending from the peripheries of the holes 71*a*, 71*b* toward the back surface.

A left-side part of the shut-off valve support member 71 is fixed to the back-surface panel 66. Specifically, the back-surface panel 66 has a space-partitioning part 66*b* extending toward the front surface from a right-side surface end portion of the back surface of the casing 60. The left-side part of the shut-off valve support member 71 is fixed by screws, etc., to a lower part of the space-partitioning part 66*b*. Therefore, the space-partitioning part 66*b* laterally partitions the internal space S of the casing 60 and the shut-off valve placement space T in which the liquid-side shut-off valve 23 and the gas-side shut-off valve 24 are placed.

The above-shut-off-valve member 72 is a panel-shaped member that vertically partitions the internal space S of the casing 60 and the shut-off valve placement space T in which the liquid-side shut-off valve 23 and the gas-side shut-off valve 24 are placed, at a position nearer to the top surface than the cut-out portion 60*a* of the first portion 65*a* of the right-side panel 65. The above-shut-off-valve member 72 is fixed by screws, etc., to the space-partitioning part 66*b* of the back-surface panel 66.

Vertically penetrating wiring holes 72*a*, 72*b* are formed in the above-shut-off-valve member 72. The purpose of the wiring holes 72*a*, 72*b* is to draw electric wires 8, 9 out to the exterior from the internal space S of the casing 60. In one or more embodiments, the electric wires 8, 9 extend from the outdoor-side electric component assembly 20 placed in the internal space S of the casing 60, while being positioned above the wiring holes 72*a*, 72*b*. Specifically, a terminal base 20*a* and/or a wiring hole 20*b* are provided to a portion of the outdoor-side electric component assembly 20 that faces the first portion 65*a* of the right-side panel 65, the electric wire 8, which is a power source wire, etc., and is stronger, extends from the terminal base 20*a*, and the electric wire 9, which is a communication wire, etc., and is weaker, extends from the wiring hole 20*b*. In one or more embodiments, the electric wire 8 is larger in diameter than the electric wire 9. The electric wire 8 is drawn out from the wiring hole 72*a*, and the electric wire 9 is drawn out from the wiring hole 72*b*. In one or more embodiments, conduit pipes 8*a*, 9*a* are attached to the wiring holes 72*a*, 72*b*, and the electric wires 8, 9 are designed to be drawn out to the exterior through the insides of the conduit pipes 8*a*, 9*a*. Wire-guiding parts 66*c*, 66*d* for directing the electric wires 8, 9 from the terminal base 20*a* and wiring hole 20*b* to the wiring holes 72*a*, 72*b* are formed in the space-partitioning part 66*b* of the back-surface panel 66, at positions lower than the terminal base 20*a* and wiring hole 20*b* and higher than the wiring holes 72*a*, 72*b*, so as to protrude toward the right-side panel 65.

The hole 71*b* of the shut-off valve support member 71 is placed below the hole 71*a* of the shut-off valve support member 71. Therefore, the gas-side shut-off valve 24 is placed below the liquid-side shut-off valve 23. Additionally, the holes 71*a*, 71*b* are placed in displaced height positions near the bottom surface of the casing 60. Specifically, the holes 71*a*, 71*b* are placed so that the liquid-side shut-off valve 23 and the gas-side shut-off valve 24 are placed in a range of ¾ or less of a height or distance H from the bottom surface of the casing 60 to the centers of the wiring holes 72*a*, 72*b*. Between the wiring holes 72*a*, 72*b* of the above-shut-off-valve member 72, the wiring hole 72*a* is placed so as not to overlap the liquid-side shut-off valve 23 in a plan view of the casing 60. In a plan view of the casing 60, the wiring hole 72*b* overlaps part of the liquid-side shut-off valve 23, but this hole is placed so as not to overlap the valve-operating part 23*g*.

The liquid-side shut-off valve 23 and the gas-side shut-off valve 24 are placed in the shut-off valve placement space T in an inclined state such that the valve-operating parts 23*g*, 24*g* are oriented at an upward incline. In one or more embodiments, the valve-operating parts 23*g*, 24*g* are oriented at an upward incline so as to be inclined toward the right-side surface of the casing 60, in a front view or rear view of the casing 60. The valve-operating parts 23*g*, 24*g* are oriented at an upward incline at the same angle of inclination. The liquid-side shut-off valve 23 and the gas-side shut-off valve 24 are placed in the shut-off valve placement space T in a state such that when the center lines 23*p*, 24*p* of the valve-operating parts 23*g*, 24*g* are extended toward the exterior of the casing 60 (toward the right-side surface), the center lines 23*p*, 24*p* of the valve-operating parts 23*g*, 24*g* do not reach the above-shut-off-valve member 72. Moreover, the center lines 23*p*, 24*p* of the valve-operating parts 23*g*, 24*g* do not reach the first portion 65*a* of the right-side panel 65 when extended toward the exterior of the casing 60 (toward the right-side surface), and the valve-operating parts 23*g*, 24*g* can be seen through the cut-out portion 60*a* of the first portion 65*a* of the right-side panel 65. Additionally, the liquid-side shut-off valve 23 and the gas-side shut-off valve 24 are placed in the shut-off valve placement space T in a state such that when the center lines 23*q*, 24*q* of the service ports 23*c*, 24*c* are extended toward the exterior of the casing 60 (toward the right-side surface), the center lines 23*q*, 24*q* of the service ports 23*c*, 24*c* do not reach the above-shut-off-valve member 72. In one or more embodiments, the service ports 23*c*, 24*c* are oriented at a downward incline so as to be inclined toward the right-side surface of the casing 60, in a front view or rear view of the casing 60. Moreover, the center lines 23*q*, 24*q* of the service ports 23*c*, 24*c* do not reach the first portion 65*a* of the right-side panel 65 when extended toward the exterior of the casing 60 (toward the right-side surface), and the service ports 23*c*, 24*c* can be seen through the cut-out portion 60*a* of the first portion 65*a* of the right-side panel 65. Additionally, the liquid-side shut-off valve 23 and the gas-side shut-off valve 24 are placed in the shut-off valve placement space T in a state such that when the center lines 23*r*, 24*r* of the indoor-side connection ports 23*b*, 24*b* are extended toward the exterior of the casing 60 (toward the back surface), the center lines 23*r*, 24*r* of the indoor-side connection ports 23*b*, 24*b* do not reach the above-shut-off-valve member 72. In a side view of the casing 60, the indoor-side connection ports 23*b*, 24*b* are oriented horizontally toward the back surface of the casing 60. Moreover, the center lines 23*r*, 24*r* of the indoor-side connection ports 23*b*, 24*b* do not reach the second portion 65*b* of the right-side panel 65 when extended toward the exterior of the casing 60 (toward the back surface), and can be seen through the cut-out portion 60*b* of the second portion 65*b* of the right-side panel 65. Additionally, the gas-side shut-off valve 24 is placed so that the valve-operating part 24*g* thereof is displaced farther away from the shut-off valve support member 71 (toward the back surface) than the valve-operating part 23*g* of the liquid-side shut-off valve 23. In a plan view of the casing 60, the hole 71*b* of the shut-off valve support member 71 is placed so as to be displaced toward the left side of the hole 71*a*, i.e., away from the right-side surface of the casing 60. Therefore, in a plan view of the casing 60, the liquid-side shut-off valve 23 and the gas-side shut-off valve 24 are placed so as to be displaced in the direction in which the valve-operating parts 23*g*, 24*g* face (toward the right-side surface). Specifically, the gas-side shut-off valve 24 is placed so as to be displaced toward the left side of the liquid-side shut-off valve 23, i.e., away from the right-side surface of the casing 60.

(3) Characteristics

Next, the characteristics of the outdoor unit 2 (heat source unit) of the air conditioning apparatus 1 (refrigeration apparatus) shall be described.

<A>

In the trunk-structured heat source unit 2, which has the outdoor fan 27 (a fan) that horizontally blows out air passing through the outdoor heat exchanger 22 (a heat exchanger), it is desirable that work relating to the shut-off valves 23, 24 during on-site installation (the work of connecting the refrigerant connection pipes 4, 5 to the indoor-side connection ports 23*b*, 24*b*, the operation of the shut-off valves 23, 24, the work of connecting charging hoses, etc., to the service ports 23*c*, 24*c*) can be performed easily. However, in a conventional heat source unit in which a shut-off valve and a shut-off valve cover are provided to a side surface of a casing so as to protrude sideways, work relating to the shut-off valve cannot be performed without taking off the shut-off valve cover, and the installation space and/or packaging size for the heat source unit will be larger.

In view of this, in one or more embodiments, the indoor-side connection ports 23*b*, 24*b* (connection ports) of the shut-off valves 23, 24 are both designed to open toward the rear-surface side of the casing 60 (see FIGS. 2, 3, and 5 to 9). Moreover, the shut-off valves 23, 24 are placed so as not to protrude from the virtual cuboid C, which is defined by the top surface, the bottom surface, the front surface, the rear surface, the left-side surface, and the right-side surface of the casing 60 (see FIGS. 2 and 3). Furthermore, in the peripheral panels 63 to 66 forming the front surface, rear surface, left-side surface, and right-side surface of the casing, a cut-out portion is made in a part (the lower part near the rear surface) of the first portion 65*a* that forms whichever of the left-side surface and the right-side surface of the casing 60 that is closer to the shut-off valves 23, 24 (the right-side surface), and the cut-out portion 60*a* of the first portion 65*a* is not covered by another member (see FIGS. 2 and 5).

Because the shut-off valves 23, 24 can be accessed through the cut-out portion 60*a* formed in the first portion 65*a* of the casing 60 without taking off a shut-off valve cover or similar member provided so as to protrude sideways from the side surface of the casing 60, operation of the shut-off valves 23, 24 and other work can be performed easily. The installation space and/or packaging size for the heat source unit 2 can also be made smaller. Additionally, the refrigerant connection pipes 4, 5 can easily be taken out toward the rear-surface side of the casing 60 due to being connected to the connection ports 23*b*, 24*b* of the shut-off valves 23, 24, and work such as the installation of the refrigerant connection pipes 4, 5 can be performed easily.

Though not done so in one or more embodiments, the connection ports 23*b*, 24*b* of the shut-off valves 23, 24 may be designed so as to open toward the front-surface side of the casing 60. In this case, the shut-off valves 23, 24 may be placed near the right front part of the casing 60, and the structure of the shut-off valves 23, 24 and the peripheries thereof may be reversed longitudinally (in front-rear direction).

In one or more embodiments, the shut-off valves 23, 24 are placed near the right rear part of the casing 60, but the shut-off valves 23, 24 may be placed near the left rear part or near the left front part of the casing 60. In this case, the placement of devices and/or refrigerant pipes in the internal space S of the heat source unit 2 may be reversed laterally (in the left-right direction).

<B>

In one or more embodiments, the peripheral panels 63 to 66 are cut out in the part (the lower part near the right-side surface) of the second portion 66*b* that forms whichever of the front surface and the rear surface of the casing 60 that is closer to the connection ports 23*b*, 24*b* (the rear surface), and the cut-out portion 60*b* of the second portion 65*b* is continuous with the cut-out portion 60*a* of the first portion 65*a* (see FIGS. 2, 5, and 7).

Because the connection ports 23*b*, 24*b* of the shut-off valves 23, 24 can be accessed through the cut-out portions 60*a*, 60*b* formed across the first portion 65*a* and the second portion 65*b* of the casing 60, the work of connecting the refrigerant connection pipes 4, 5 to the shut-off valves 23, 24 can be performed easily.

The connection ports 23*b*, 24*b* of the shut-off valves 23, 24 may be opened not toward the rear-surface side of the casing 60, but toward the front-surface side.

Among the peripheral panels 63 to 66, the right-side panel 65 configures the first peripheral panel forming both the first portion 65*a* and the second portion 65*b*, but this configuration is not provided by way of limitation. For example, among the peripheral panels 63 to 66, the right-side panel 65 may configure a second peripheral panel forming the first portion 65*a*, and the rear-surface panel 66 may configure a third peripheral panel forming the second portion 65*b*.

<C>

In one or more embodiments, the casing 60 is further provided with a space-forming member 70 that partitions the internal space S of the casing 60 and a shut-off valve placement space T in which the shut-off valves 23, 24 are placed, and the cut-out portion 60*a* of the first portion 65*a* faces the shut-off valve placement space T (see FIGS. 2, 5, and 7).

The shut-off valve placement space T can be accessed through the cut-out portion 60*a* of the first portion 65*a*, and work such as the operation of the shut-off valves 23, 24 can be performed easily.

The cut-out portion 60*b* of the second portion 65*b* also faces the shut-off valve placement space T (see FIGS. 2, 5, and 7).

The shut-off valve placement space T can be accessed through the cut-out portion 60*b* of the second portion 65*b* as well, and work such as the operation of the shut-off valves 23, 24 can be performed easily.

<D>

In one or more embodiments, the space-forming member 70 has a shut-off valve support member 71 that supports the shut-off valves 23, 24, and the shut-off valve support member 71 is positioned between the front surface of the casing 60 and the shut-off valves 23, 24 (see FIGS. 5 and 6).

When the shut-off valves 23, 24 are placed such that the connection ports 23*b*, 24*b* face toward the rear-surface side of the casing 60, the internal space S of the casing 60 and the shut-off valve placement space T can be partitioned in the front-rear direction by the shut-off valve support member 71.

Though not employed in one or more embodiments, a configuration may be used in which the shut-off valve support member 71 is positioned between the rear surface of the casing 60 and the shut-off valves 23, 24 when the shut-off valves 23, 24 are placed such that the connection ports 23*b*, 24*b* open toward the front-surface side of the casing 60.

<E>

In one or more embodiments, the space-forming member 70 has an above-shut-off-valve member 72 positioned above the shut-off valves 23, 24 (see FIGS. 5 to 9).

The internal space S of the casing 60 and the shut-off valve placement space T can be vertically partitioned by the above-shut-off-valve member 72.

Embodiments of the present invention was described above, but it is understood that various changes can be made to the previously-described embodiments and/or details, as long as such changes do not deviate from the scope and range of the present invention set forth in the claims.

The present invention is widely applicable to heat source units for refrigeration apparatuses provided with fans that horizontally blow out air passing through heat exchangers.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

1 Air conditioning apparatus (refrigeration apparatus)
2 Outdoor unit (heat source unit)
20 Outdoor-side electric component assembly (electric component assembly)
22 Outdoor heat exchanger (heat exchanger)
23 Liquid-side shut-off valve (first shut-off valve)
23*b* Indoor-side connection port (connection port)
24 Gas-side shut-off valve (second shut-off valve)
24*b* Outdoor-side connection port (connection port)
27 Outdoor fan (fan)
60 Casing
60*a*, 60*b* Cut-out portions
63 Front-surface panel (peripheral panel)
64 Left-side panel (peripheral panel)
65 Right-side panel (peripheral panel, first peripheral panel, second peripheral panel)
65*a* First portion
65*b* Second portion
66 Rear-surface panel (peripheral panel, third peripheral panel)
70 Space-forming member
71 Shut-off valve support member
72 Above-shut-off-valve member
C Virtual cuboid
S Internal space
T Shut-off valve placement space

CITATION LIST

Patent Literature

Patent Literature 1: Japanese Laid-open Patent Publication No. 2009-24903

The invention claimed is:

1. A heat source unit for a refrigeration apparatus, comprising:

a casing;

a heat exchanger disposed in an internal space of the casing, and that performs heat exchange between a refrigerant and air;

a fan disposed in the internal space of the casing and that horizontally blows out the air passing through the heat exchanger;

at least one shut-off valve comprising a connection port that opens in a direction toward either a front-surface side or a rear-surface side of the casing; and peripheral panels that form a front surface, a rear surface, a left-side surface, and a right-side surface of the casing, wherein the shut-off valve does not protrude from a virtual cuboid defined by a top surface, a bottom surface, the front surface, the rear surface, the left-side surface, and the right-side surface of the casing, the peripheral panels comprise a first portion that forms the right-side surface, and the first portion has a first cut-out portion that exposes the shut-off valve to an exterior of the casing such that the shut-off valve is visible from a right side of the casing without removing any intervening structures between the shut-off valve and the right-side surface of the casing.

2. The heat source unit for a refrigeration apparatus according to claim 1, wherein the peripheral panels further comprise a second portion that forms the front surface of the casing that the connection port opens toward, the second portion has a second cut-out portion that exposes the shut-off valve such that the shut-off valve is visible from the front-surface side of the casing without removing any intervening structures between the shut-off valve and the front surface of the casing, and the second cut-out portion is continuous with the first cut-out portion.

3. The heat source unit for a refrigeration apparatus according to claim 1, wherein a first peripheral panel among the peripheral panels forms both the first portion and the second portion.

4. The heat source unit for a refrigeration apparatus according to claim 1, wherein a first peripheral panel among the peripheral panels forms the first portion, and a second peripheral panel among the peripheral panels forms the second portion.

5. The heat source unit for a refrigeration apparatus according to claim 1, further comprising:

a space-forming member disposed in the casing, wherein the space-forming member partitions the internal space of the casing and a shut-off valve placement space, and the first cut-out portion provides exposes the shut-off valve placement space to the exterior of the casing such that the shut-off valve is visible from the right side of the casing without removing any intervening structures between the shut-off valve and the right-side surface of the casing.

6. The heat source unit for a refrigeration apparatus according to claim 5, wherein the space-forming member comprises a shut-off valve support member that supports the shut-off valve.

7. The heat source unit for a refrigeration apparatus according to claim 6, wherein the shut-off valve is disposed between the shut-off valve support member and the front surface of the casing.

8. The heat source unit for a refrigeration apparatus according to claim 5, wherein the space-forming member comprises an above-shut-off-valve member above the shut-off valve.

9. The heat source unit for a refrigeration apparatus according to claim 1, wherein the peripheral panels further comprise a second portion that forms the rear surface of the casing that the connection port opens toward, the second portion has a second cut-out portion that exposes the shut-off valve such that the shut-off valve is visible from the rear-surface side of the casing without removing any intervening structures between the shut-off valve and the rear surface of the casing, and the second cut-out portion is continuous with the first cut-out portion.

10. A heat source unit for a refrigeration apparatus, comprising:

a casing;

a heat exchanger disposed in an internal space of the casing, and that performs heat exchange between a refrigerant and air;

a fan disposed in the internal space of the casing and that horizontally blows out the air passing through the heat exchanger;

at least one shut-off valve comprising a connection port that opens in a direction toward either a front-surface side or a rear-surface side of the casing; and peripheral panels that form a front surface, a rear surface, a left-side surface, and a right-side surface of the casing, wherein the shut-off valve does not protrude from a virtual cuboid defined by a top surface, a bottom surface, the front surface, the rear surface, the left-side surface, and the right-side surface of the casing, the peripheral panels comprise a first portion that forms the left-side surface, and the first portion has a first cut-out portion that exposes the shut-off valve to an exterior of the casing such that the shut-off valve is visible from a left side of the casing without removing any intervening structures between the shut-off valve and the left-side surface of the casing.

11. The heat source unit for a refrigeration apparatus according to claim 10, wherein the peripheral panels further comprise a second portion that forms the front surface of the casing that the connection port opens toward, the second portion has a second cut-out portion that exposes the shut-off valve such that the shut-off valve is visible from the front-surface side of the casing without removing any intervening structures between the shut-off valve and the front surface of the casing, and the second cut-out portion is continuous with the first cut-out portion.

12. The heat source unit for a refrigeration apparatus according to claim 10, wherein a first peripheral panel among the peripheral panels forms both the first portion and the second portion.

13. The heat source unit for a refrigeration apparatus according to claim 10, wherein a first peripheral panel among the peripheral panels forms the first portion, and a second peripheral panel among the peripheral panels forms the second portion.

14. The heat source unit for a refrigeration apparatus according to claim 10, further comprising:

a space-forming member disposed in the casing, wherein the space-forming member partitions the internal space of the casing and a shut-off valve placement space, and the first cut-out portion provides exposes the shut-off valve placement space to the exterior of the casing such that the shut-off valve is visible from the left side of the casing without removing any intervening structures between the shut-off valve and the left-side surface of the casing.

15. The heat source unit for a refrigeration apparatus according to claim 14, wherein the space-forming member comprises a shut-off valve support member that supports the shut-off valve.

16. The heat source unit for a refrigeration apparatus according to claim 15, wherein the shut-off valve is disposed between the shut-off valve support member and the front surface of the casing.

17. The heat source unit for a refrigeration apparatus according to claim 14, wherein the space-forming member comprises an above-shut-off-valve member above the shut-off valve.

18. The heat source unit for a refrigeration apparatus according to claim 10, wherein the peripheral panels further comprise a second portion that forms the rear surface of the casing that the connection port opens toward, the second portion has a second cut-out portion that exposes the shut-off valve such that the shut-off valve is visible from the rear-surface side of the casing without removing any intervening structures between the shut-off valve and the rear surface of the casing, and the second cut-out portion is continuous with the first cut-out portion.

* * * * *